United States Patent [19]

Tanabe

[11] Patent Number: 4,814,558

[45] Date of Patent: Mar. 21, 1989

[54] CONTACT MECHANISM FOR A SWITCH

[75] Inventor: Yoshio Tanabe, Miyagi, Japan

[73] Assignee: Alps Electric Co., Ltd., Japan

[21] Appl. No.: 545,140

[22] Filed: Oct. 25, 1983

[30] Foreign Application Priority Data

Oct. 25, 1982 [JP] Japan ..... 57-160236

[51] Int. Cl.[4] ..... H01H 21/40

[52] U.S. Cl. ..... 200/440; 200/462

[58] Field of Search ..... 200/67 P, 67 B

[56] References Cited

U.S. PATENT DOCUMENTS 1,519,924 12/1924 Nero ..... 200/67 PK
1,781,710 11/1930 Stevens et al. ..... 200/67 B
2,571,623 10/1951 Scholin ..... 200/67 PK
4,011,419 3/1977 Anderson ..... 200/67 B
4,214,219 7/1980 DiMarco et al. ..... 335/23
4,230,919 10/1980 Schantz et al. ..... 200/67 B

*Primary Examiner*—John W. Shepperd
*Attorney, Agent, or Firm*—Guy W. Shoup; Paul J. Winters; Leighton K. Chong

[57] ABSTRACT

An improved contact mechanism for a switch is disclosed in which impact between contacts is reduced or moderated to minimize rebound of the contacts thereby to prolong the life of the switch. The contacts are sufficiently spaced apart from each other when the switch is in a stable open position, but when the switch is operated, the movable contact is first moved gradually to an intermediate position toward the fixed contact whereafter it is moved rapidly to the fixed contact over a thus reduced distance.

1 Claim, 2 Drawing Sheets

CONTACT MECHANISM FOR A SWITCH

BACKGROUND OF THE INVENTION

This invention relates to a switch of the type wherein a movable contact is operated by a coil spring.

A typical one of conventional switches of this type has a structure as shown in FIG. 1. Referring first to FIG. 1, the switch includes a switch body 1 which has a center terminal 2 and a fixed contact terminal 3 secured thereto. The center terminal 2 has a recessed portion 5 adjacent an upright portion 4 thereof, and an end 7 of an operating lever 6 is pivotally mounted on the recessed portion 5 of the center terminal 2. An operating member 8 is mounted for sliding movement into and out of the switch body 1, and when pushed in, an end 9 thereof pushes the other end 10 of the operating lever 6 inwardly. A movable contact receiving recess 12 is formed in an upright portion 11 of the operating lever 6 which portion 11 serves as a movable part of the lever 6. A movable contact member 13 is pivotally received in the recess 12 of the operating lever 6 so that it can be rocked about a movable fulcrum provided by the recess 12. A movable contact 15 is formed on one of opposite surfaces of a rocking end of the movable contact member 13 and is opposed to a fixed contact 16 of the fixed contact terminal 3. The movable contact member 13 further has a spring mounting portion 17 between the movable contact 15 and the end 14 thereof, and an end of a tension spring 18 is connected to the spring mounting portion 17. The other end 20 of the tension spring 18 is secured to a spring mounting portion 21 of the center terminal 2 and thus integrally secured to the switch body 1 to urge the movable contact member 13 to move the movable contact 15 thereof toward the recess 12 of the operating lever 6. FIG. 1(A) shows the switch in a stable open position, and in this position, a stop 22 provided on the center terminal 2 is abutted by the operating lever 6 to stop and limit movement of the operating lever 6 toward the operating member 8. Further, in this position, the end 14 of the movable contact member 13 which serves as a movable fulcrum of the movable contact member 13 is located, in FIG. 1(A), on the right side of a line of action which interconnects opposite ends 19, 20 of the tension spring 18. As a result, the movable contact member 13 is urged by a clockwise rocking moment due to the tensile force of the tension spring 18 and hence a rear face 23 of the movable contact member 13 is abutted against a side wall 24 of the switch body 1 which side wall 24 serves as a disengagement limiting member of the switch.

In such a construction as described above, however, when the operating member 8 is pushed in, the operating lever 6 is pivoted thereby and the end 14 of the movable contact member 13 is first moved to the line of action of the tension spring 18 as shown in FIG. 1(B) and then is further moved across the line of action whereupon the movable contact member 13 is rocked counterclockwise about the end 14 thereof by the urging of the tension spring 18 until the movable contact 15 is contacted with the fixed contact 16 as shown in FIG. 1(C). During this operation, relative positions between the contacts 15, 16 when the switch is in the position as shown in FIG. 1(B) at which rocking moment is reversed are similar to those when the switch is in the position as shown in FIG. 1(A), and thus the contacts 15, 16 are spaced from each other a relatively large distance. Accordingly, acceleration of the movable contact 15 at the instant when it is contacted with the fixed contact 16 is naturally relatively high, causing rebounding of the movable contact member 13 upon contacting of the movable contact 15. As a result, sparks are naturally large and will cause a problem that the contacts 15, 16 suffer from serious corrosion and wear which will reduce the life of the contacts.

SUMMARY OF THE INVENTION

Accordingly, it is an object of the present invention to provide a contact mechanism for a switch which eliminates such defects of conventional contact mechanisms as described above.

It is another object of the invention to provide a contact mechanism for a switch wherein impact between contacts is weakened to reduce ocurrence of rebounding of the movable contact thereby to prolong the life of the contacts.

In order to attain these objects, contacts of a contact mechanism for a switch according to the present invention are held spaced apart a sufficient distance from each other when the switch is in an open position, but when the switch is operated, they are first moved sufficiently to each other before a rocking moment of a movable contact is reversed. Accordingly, after reversal of the rocking moment, a movable one of the contacts is moved rapidly a relatively short distance until it is contacted with the other contact, and hence impact of the movable contact upon the fixed contact is reduced relatively low.

These and other features, objects and advantages will become apparent from the following detailed description of a preferred embodiment taken in conjunction with the accompanying drawings.

DETAILED DESCRIPTION OF THE INVENTION

Figure 1A:
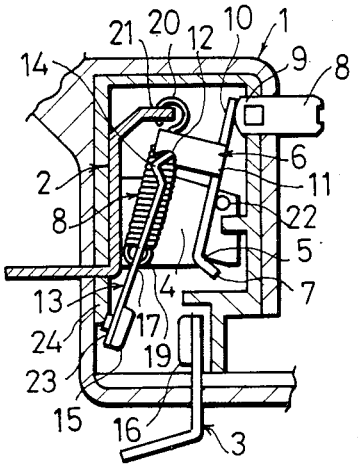
Fig.1(A) PRIOR ART
FIGS. 1(A), 1(B) and 1(C) are cross sectional views of a conventional switch, illustrating operations of the switch in successive order.
Figure 1B:
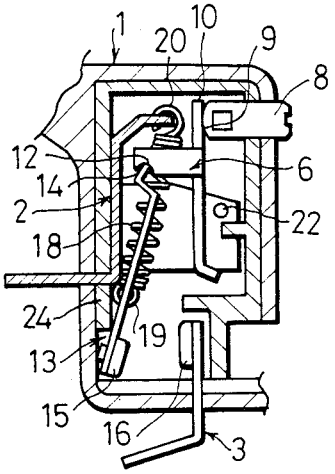
Fig.1(B) PRIOR ART
Figure 1C:
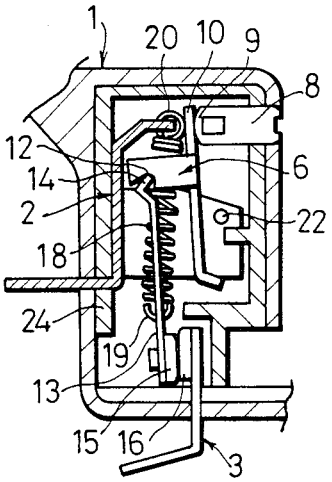
Fig.1(C) PRIOR ART
Figure 2A:
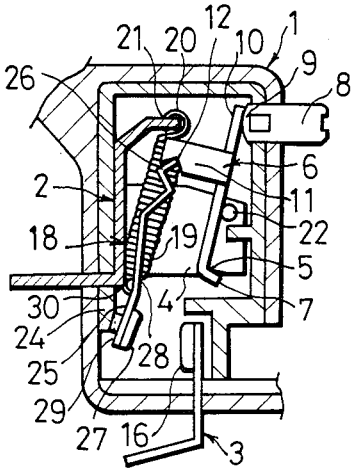
FIGS. 2(A), 2(B) and 2(C) are similar cross sectional views of an embodiment of a switch incorporating a contact mechanism according to the present invention, illustrating operations of the switch in similar successive order.
Figure 2B:
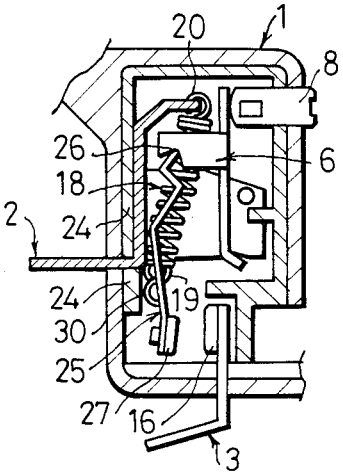
Figure 2C:
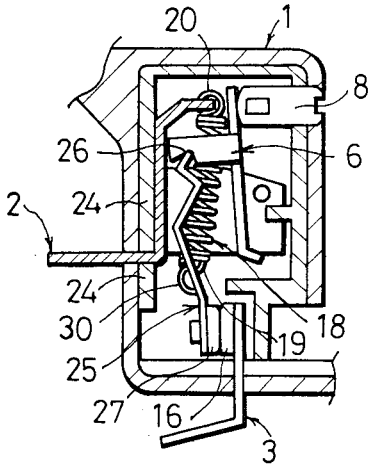

Referring to FIGS. 2(A) to 2(C), common parts or elements are designated by like reference numerals to those of FIGS. 1(A) to 1(C), and description will be given principally of a structure which is different from the conventional structure as described hereinabove. A movable contact member 25 is received at an end 26 thereof by a movable contact receiving recess 12 of an operating lever 6 so that it can be rocked about a movable fulcrum provided by the recess 12 of the operating lever 6. A movable contact 27 is formed on one of opposite surfaces of the other rocking end of the movable contact member 25 and is opposed to a fixed contact 16 of a fixed contact terminal 3. The movable contact member 25 is bent at an intermediate portion thereof in a direction opposite to the movable contact 27 thereon. The movable contact member 25 has a spring mounting portion 28 between the movable contact 27 and the end 26 thereof, and an end 19 of a tension spring 18 is connected to the spring mounting portion 28. The other end 20 of the tension spring 18 is secured to a spring mounting portion 21 of a center terminal 2 and hence is integrally secured to a switch body 1 to urge the movable contact member 25 to move the movable contact 27 toward the recess 12 of the operating lever 6. FIG. 2(A) illustrates the switch in a stable open position, and in this position, the movable contact member 25 is under the influence of a clockwise rocking moment to move the movable contact member 25 away from the fixed contact 16 due to a tensile force of the tension spring 18 in a similar manner as in the case of FIG. 1(A), and thus, the opposite surface 29 of the movable contact member 25 is abutted against a side wall of the switch body 1. The movable contact member 25 further has a projection 30 formed on a surface thereof opposite to the movable contact 27 between the movable contact 27 and the spring mounting portion 28 thereof. The projection 30 may be formed by suitable means such as embossing, stamping and so on. The projection 30 is so positioned that it is not contacted with the side wall 24 when the switch is in the position as shown in FIG. 2(A), and as the operating member 8 is pushed in, it will be soon contacted with and slide on the side wall 24.

In this construction, when the switch is in its open position as shown in FIG. 2(A), the operating lever 6 is abutted against a stop 22 under the influence of a tensile force of the tension spring 18 to hold the operating member 8 to an outwardly projected position while the movable contact member 25 is under the influence of a clockwise rocking moment and is abutted at the reverse surface 29 thereof against the side wall 24 of the switch body 1 so that the movable contact 27 is held spaced apart from the fixed contact 15 a distance required and sufficient to allow electric disconnection between the two contacts 15, 27. As the operating member 8 is pushed in, the movable contact member 25 is moved downwardly as seen in FIG. 2(A) to contact the projection 30 thereon with the side wall 24. As the operating member 8 is further pushed in, the movable contact member 25 is rocked in a counterclockwise direction about a fulcrum provided by the projection 30 thereon to move the contact member 27 thereon toward the fixed contact 15 while the end 26 of the movable contact member 25 is moved to a line of action of the tension spring 18 as seen in FIG. 2(B). At this position of the movable contact member 25, the movable contact 27 assumes a position nearest to the fixed contact 15 before reversal of the rocking moment. As the end 26 of the movable contact with member 25 further moves beyond the line of action of the tension spring 18 to cause reversal of the rocking moment, the movable contact member 25 is rocked about the end 26 thereof to abut the movable contact 27 thereon against the fixed contact 15 as seen in FIG. 2(C). If the operating member 8 is then released from its pushing in operation when the switch is in the position as shown in FIG. 2(C), the operating member 6 is pivoted clockwise about the recessed portion 5 of the central terminal 2 by the urging of the tension spring 18. As a result, the end 26 of the movable contact member 25 is moved across the line of action of the tension spring 18 so that a reverse rocking moment now acts upon the movable contact member 25 in the opposite disengaging direction. Consequently, the movable contact 27 thereon is disengaged from the fixed contact 16 as seen in FIG. 2(A).

As apparent from the foregoing description, according to the present invention, contacts are spaced apart a sufficient distance from each other when the switch is in its stable open position, but when the switch is brought to its close position, the contacts are first moved gradually toward each other and then are quickly moved into contact with each other. As a result, the contacts are contacted with each other with reduced impact and hence rebound of the contacts will not readily occur, thereby assuring prolongation of the life of the contacts and hence of the switch.

What is claimed is:

1. In a contact mechanism for a switch of the type which includes an operating lever, a movable contact member mounted on a movable portion of said operating lever for rocking motion about a movable fulcrum thereof, a movable contact on one of opposite surfaces of a rocking end of said movable contact member, and a tension spring having one end connected to a spring mounting portion of said movable contact member between said movable contact and said movable fulcrum of said movable contact member, the other end of said tension spring being secured to a fixed portion of said switch to urge said movable contact towards said movable fulcrum, whereby, when said movable fulcrum of said movable contact member is moved across a line of action of said tension spring by said operating lever, a rocking moment of said movable contact is reversed so that said movable contact may be either brought into contact with the fixed contact or brought out of contact with said fixed contact and into contact with a disengaging limiting member on said fixed portion of the switch, the improvement wherein said movable contact is formed with a V-shaped bend and has a projection provided on a surface opposite to said movable contact between said movable contact and said spring mounting portion thereof, said disengaging limiting member being abutted by said projection of said movable contact member while said movable fulcrum of said movable contact member is at a position to cause a rocking moment in the direction to move said movable contact away from said fixed contact, said disengaging limiting member being abutted at successive different positions by said projection of said movable contact member as said movable fulcrum of said movable contact member is moved, and wherein, while said movable fulcrum of said movable contact member is being moved towards a position where said movable contact is caused to snap towards said fixed contact, said movable contact member is rocked about said projection thereon which is abutted against said disengaging limiting member thereby to move said movable contact correspondingly about said projection, said movable contact thereby being positioned adjacent said fixed contact prior to when said movable fulcrum of said movable contact member is at a position to cause reversal of the rocking moment of said tension spring.

* * * * *